United States Patent [19]

Couch

[11] 4,021,953

[45] May 10, 1977

[54] SHOPPING CART DISPLAY GUIDE SELECTOR

[76] Inventor: Vernon Evan Couch, Box 877, Iola, Tex. 77861

[22] Filed: Nov. 17, 1975

[21] Appl. No.: 632,197

[52] U.S. Cl. ..... 40/308; 40/68

[51] Int. Cl.[2] ..... G09F 11/02

[58] Field of Search ..... 40/68, 308, 114, 68 R, 40/334, 335

[56] References Cited

UNITED STATES PATENTS

| | | | |
|---|---|---|---|
| 2,888,761 | 6/1959 | Miller | 40/308 |
| 2,918,741 | 12/1969 | Welter et al. | 40/308 |
| 3,281,978 | 11/1966 | Drugan et al. | 40/308 |
| 3,358,396 | 12/1967 | Prince | 40/68 |
| R24,297 | 4/1957 | Brockway | 40/308 |

*Primary Examiner*—G.E. McNeill
*Assistant Examiner*—Wenceslao J. Contreras
*Attorney, Agent, or Firm*—Cox, Smith, Smith, Hale & Guenther Incorporated

[57] ABSTRACT

This invention is a shopping cart display guide selector for attachment to the handle of a shopping cart. The display guide selector has an outer cylinder clamped to the handle of the shopping cart. An inner cylinder is rotatably carried therein. A knob allows a shopper to turn the inner cylinder to any given position. On the inner cylinder is attached a sheet of paper containing information such as the store specials. A magnifying viewing window is contained in the outer cylinder so that a shopper may easily read information contained on the paper. By removal of a pin, the inner cylinder may be removed and the paper replaced to give other information. Friction between the inner cylinder and outer cylinder maintains the inner cylinder in any position to which it may be rotated by the shopper.

5 Claims, 6 Drawing Figures

SHOPPING CART DISPLAY GUIDE SELECTOR

BACKGROUND OF THE INVENTION

The present invention relates to an apparatus for the displaying of information on a shopping cart and, more particularly, to the use of a self service store shopping cart with the specials offered in the store being visibly displayed on the shopping cart. This invention is directed specifically toward a cylinder display informational device attached to the handle of a shopping cart.

BRIEF DESCRIPTION OF THE PRIOR ART

Prior to the present invention other types of construction for shopping cart informational devices were available. Some consisted of round, triangular, star, square and hexigonal shaped devices attached between the vertical handle supports or to the handle itself. The more pertinent art noted was Brochway (U.S. Reissue Pat. No. 24,297) and Drugan (U.S. Pat. No. 3,281,978). These informational devices were hard to read, and the information contained thereon was either easily mutulated or hard to change as the information changed.

SUMMARY OF THE INVENTION

It is the object of the present invention to provide the customer with a clearly readable view of the daily specials and featured products carried by a self service store by a display on the shopping cart which is rotatable operatable by the customer.

It is yet another object of the present invention to provide a magnified shopping display guide indicating particular product specials being offered with the store.

A further object of the present invention is to provide an improved shopping special display guide which is easily detachable from the shopping cart. The specials are viewed through an outer magnified cylinder that is semi-permanently attached to the handle of a pushcart by means of clamps on each end. The construction and arrangement of the display allow convenient removal and replacement of daily or weekly specials information.

It is also an object of the present invention to provide an economically manufactured, simple structure of a sound construction which will be both efficient and practical in use.

DESCRIPTION OF THE PREFERRED EMBODIMENT

Figure 1:
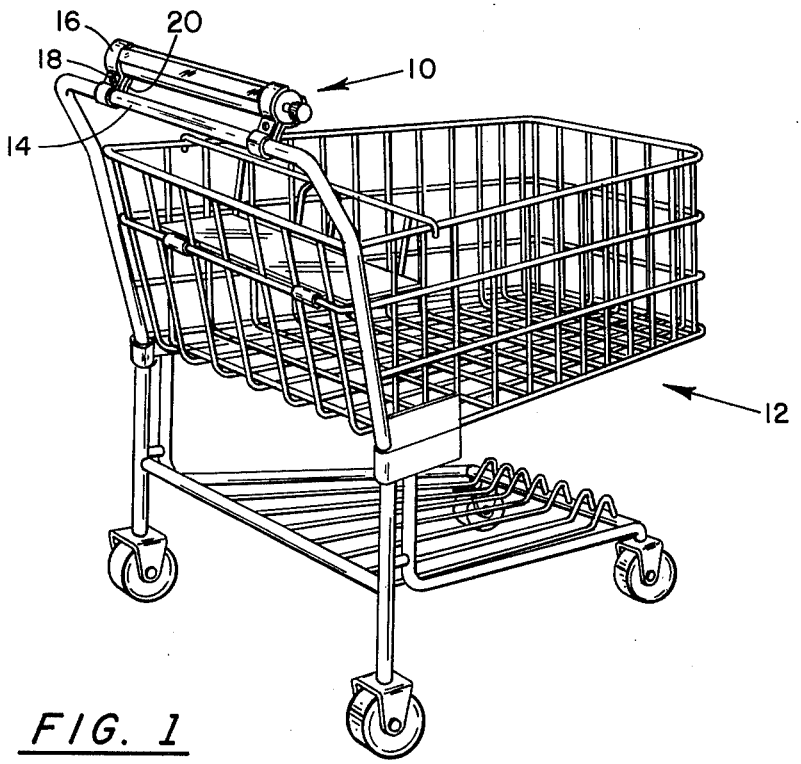
FIG. 1 is a perspective view of a shopping cart with the present invention attached thereto.

Referring now to FIG. 1 of the drawings, there is shown, represented generally by the numeral 12, a pictorial view of a typical shopping cart of a type generally used in self-service stores with a specials shopping guide 10 being attached to the shopping cart handle 14 by means of clamp brackets 16 and screws 18.

Figure 2:
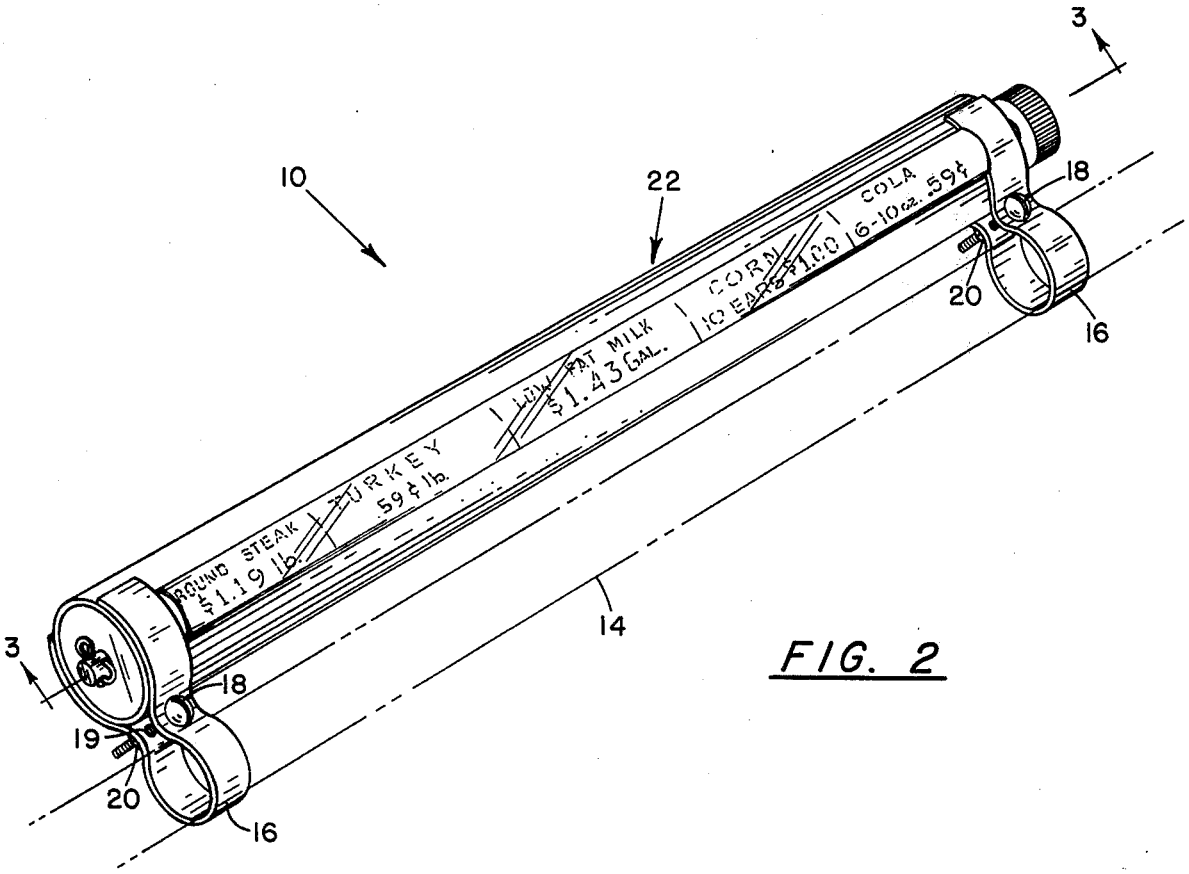
FIG. 2 is a closeup perspective view of the shopping cart display guide selector.

Referring now to FIG. 2 of the drawings which shows an exploded perspective view of the specials shopping guide 10, an outer cylinder 22 is attached to the shopping cart handle 14 (shown in broken lines) by means of end clamp brackets 16. End clamp brackets 16 apply pressure to both the handle 14 and the cylinder 22 when secured with screws 18 and nuts 20 through holes 19.

Figure 3:
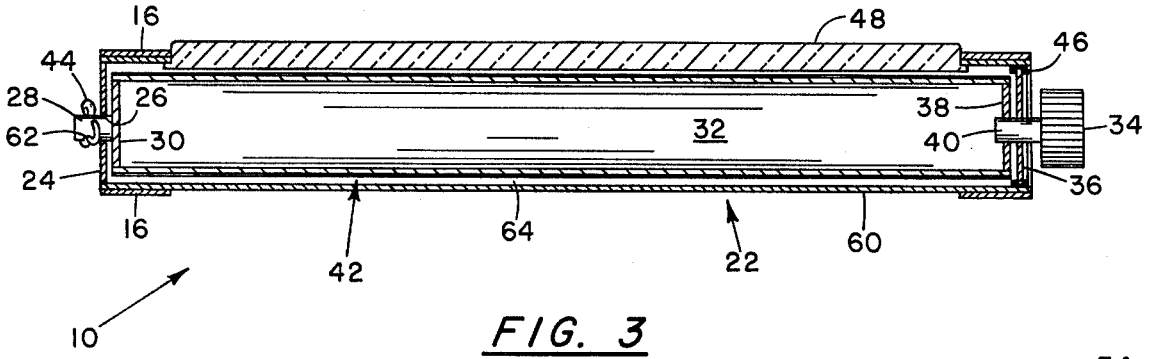
FIG. 3 is a longitudinal section of FIG. 2 taken along section lines 3-3 of FIG. 2.
Figure 6:
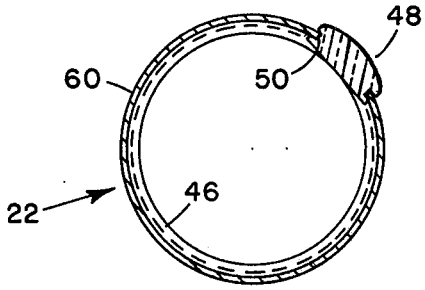
FIG. 6 is a cross sectional view of the outer cylinder taken along section lines 6-6 of FIG. 4.

The cross sectional view of FIG. 3 shows the outer cylinder 22 which consists of a cylindrical tube 60 with a magnifying window 48 forced from inside the cylinder tube to snap into place in the cutout 50. (See FIG. 6.) The magnifying window 48 may be made from either glass or plastic. End cap 24 is secured to cylinder 60 by any convenient means, such as spot welding or the like. A center hole 26 located in the center of end cap 24. Inside the opposite end of the cylinder tube 60 is a rubber bushing 46 permanently secured in place by any suitable means such as a bonding adhesive.

The inner cylinder 42 consists of a cylindrical tube 32 with an end plate 30 attached thereto by any suitable means such as spot welding. A cylindrical pin axis 28 on the center of end plate 30 contains a hole 62 therein for receiving cotter key 44. On the opposite end of the cylinder tube 32 is a knob 34. An outer end plate 36 attached to the knob 34 and the inner end plate 38 to form one integral body all of which is attached to a center cylindrical shaft 40 by any conventional means. The inner end plate 38 is attached to the inner cylinder 32 by any convenient means (such as welding) thus forming the complete inner cylinder 42.

The inner cylinder 42 is inserted into the outer cylinder 22 with the cylindrical pin axis 28 protruding out of the hole 26 in end plate 24. The inner cylinder 42 is secured in place by a cotter pin 44 inserted through the hole 62. The opposite outer end plate 36 is forced into the center groove of rubber bushing 46. The rubber bushing 46 provides friction against the rotation of end plate 36 to hold the inner cylinder in any particular location desired by the shopper. The customer may turn the knob 34 and inner cylinder 42 to the particular advertised special desired. The inner cylinder 34 will remain in that position due to the friction of the rubber bushing 46. After the inner cylinder 42 has been completely inserted into the outer cylinder 22, a sufficient space 64 is provided to insure a trouble free rotation which is detered only by the designed-in friction of the outer end plate 36 turning in the rubber bushing 46.

Figure 4:
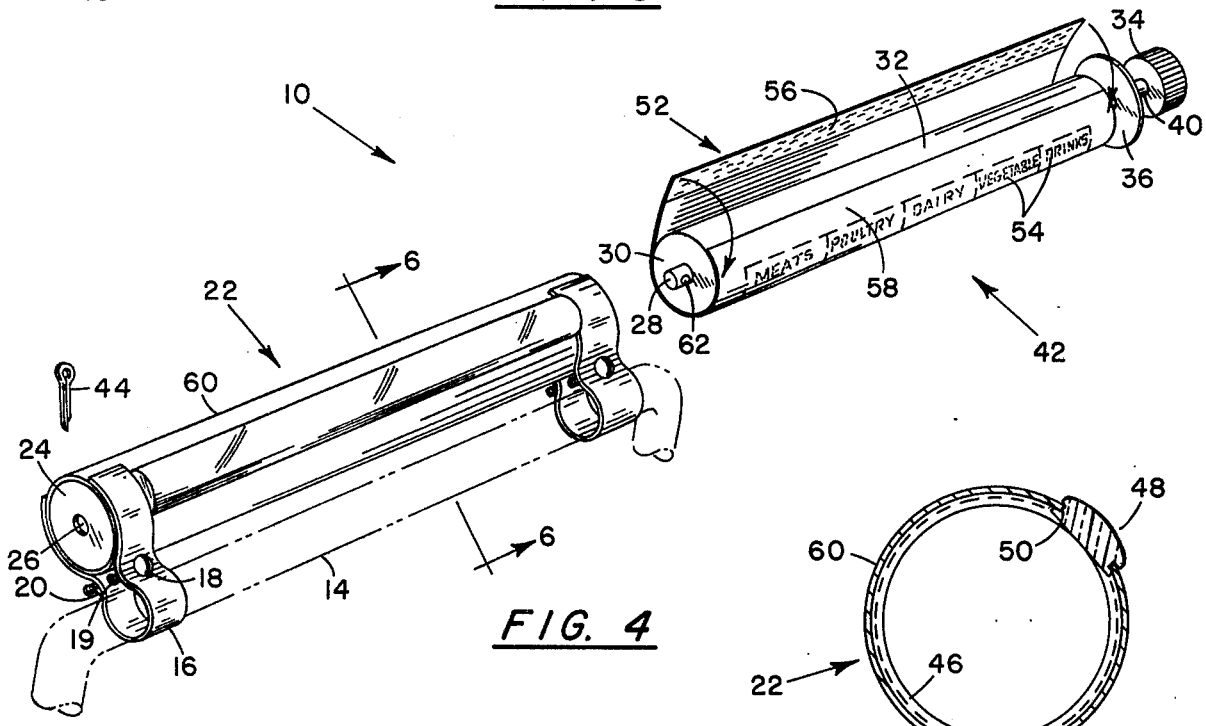
FIG. 4 is an exploded perspective view of the shopping cart display guide selector.
Figure 5:
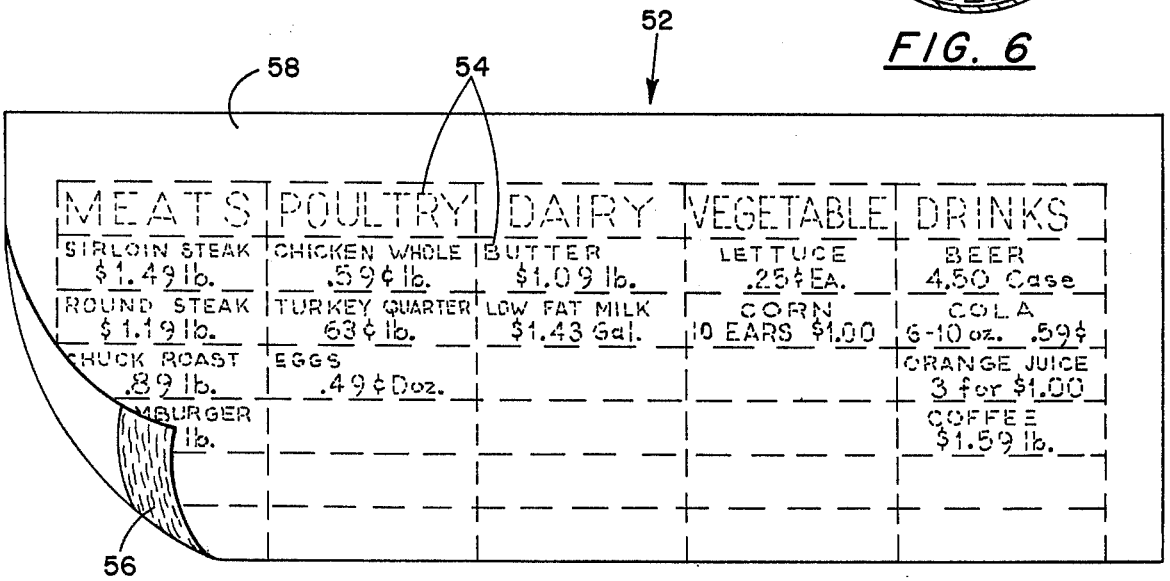
FIG. 5 is a front elevation view of an advertisement page to be used in the shopping guide selector with information contained thereon, one corner being turned up to illustrate a a strip of adhesive on the reverse side.

As shown in FIG. 4 all that is required to replace the advertised specials is to remove the cotter pin 44 and horizontally pull out the inner cylinder 42 from the outer cylinder 22 by the knob end 34 thus leaving the outer cylinder 22 attached to the handle 14. Attached to the outer wall of the inner cylinder 42 is a sheet of paper 52 having printed matter thereon as indicated by the numeral 54. A longitudinal adhesive strip 56 approximately one half inch wide on the back side will adhere to the longitudinal blank space 58 provided on the printed side. This makes the paper 52 easily removable and replaceable with another sheet of printed matter as indicated by directional arrows in FIG. 4. This eliminates the necessity to adhere the paper to the cylinder which prevents the possibility of paper buildup on the inner cylinders or problems of subsequent removal. FIG. 5 shows the sheet of paper 52 with one corner turned up to illustrate the adhesive strip 56.

It is to be understood that to assist a customer in a store, any information or arrangement thereof may be printed on the paper 52 so long as all information will show through the magnified glass window 48 when rotated into place. It is to be noted that by printing to the bottom of the paper 52, which is on the opposite side from the adhesive strip, that when placed on the inner cylinder 42 there will be a complete circumferential register of items without a large blank space.

I claim:

1. An information device for use with a shopping cart having a horizontal handle, said device being attached to said handle with said device being parallel to, forwardly of and upwardly of said handle, said device including:

an outer cylinder having a viewing window substantially longitudinal therewith;

an inner cylinder rotatably located in said outer cylinder, said inner cylinder having a knob means on one end thereof for rotating said inner cylinder;

means for retaining said inner cylinder in said outer cylinder;

friction means between said inner cylinder and said outer cylinder to frictionally maintain said inner cylinder in any desired position;

means for attaching said outer cylinder to said handle;

said inner cylinder having a surface for attaching an information sheet thereto, sufficient space being allowed between said inner and outer cylinder for said information sheet, information on said sheet being readable through said viewing window, said viewing window having a magnification factor to better read said information;

said means for attaching including a C-shaped portion and opposing arcuate portions extending from said C-shaped portion, bolt means extending between said C-shaped portion and said opposing arcuate portions, said opposing arcuate portions clamping to said outer cylinder and said C-shaped portion adapted for clamping to said horizontal handle upon tightening said bolt means.

2. The information device as recited in claim 1 wherein said retaining means includes a pin that may be removed, subsequently said inner cylinder being withdrawn from said outer cylinder, said information sheet being replaced, said inner cylinder being re-inserted in said outer cylinder and said pin means being replaced.

3. The information device as recited in claim 2 wherein said pin is inserted in a hole of a rotating axis attached to a first end of said inner cylinder, said rotating axis extending through an end plate of said outer cylinder.

4. The information device as recited in claim 3 wherein said friction means includes a rubber ring permanently located between a circular plate attached to a second end of said inner cylinder, said rubber ring providing friction between said inner and outer cylinders.

5. The information device as recited in claim 4 wherein said opposing arcuate portions are tightened to each end of said outer cylinder with said viewing window being located therebetween, said viewing window being located at the upper rear of said outer cylinder for easy viewing therethrough.

* * * * *